US009821205B2

(12) United States Patent
Chalifoux

(10) Patent No.: US 9,821,205 B2
(45) Date of Patent: Nov. 21, 2017

(54) OVAL COMPRESSION UNIT FOR INTERCHANGEABLE GOLF GRIP

(71) Applicant: Paul Chalifoux, Naples, FL (US)

(72) Inventor: Paul Chalifoux, Naples, FL (US)

( * ) Notice: Subject to any disclaimer, the term of this patent is extended or adjusted under 35 U.S.C. 154(b) by 0 days.

(21) Appl. No.: 15/406,490

(22) Filed: Jan. 13, 2017

(65) Prior Publication Data

US 2017/0304698 A1 Oct. 26, 2017

Related U.S. Application Data

(63) Continuation-in-part of application No. 15/176,200, filed on Jun. 8, 2016, now Pat. No. 9,656,138, which is a continuation-in-part of application No. 15/138,162, filed on Apr. 25, 2016, now Pat. No. 9,452,333.

(51) Int. Cl.
*A63B 53/14* (2015.01)
*A63B 60/16* (2015.01)
*A63B 60/14* (2015.01)

(52) U.S. Cl.
CPC ..... *A63B 60/16* (2015.10); *A63B 53/14* (2013.01); *A63B 60/14* (2015.10)

(58) Field of Classification Search
CPC ..... A63B 60/16; A63B 53/14; A63B 60/14
See application file for complete search history.

(56) References Cited

U.S. PATENT DOCUMENTS 3,112,547 A * 12/1963 Poe ..... F16B 19/1081 411/360
5,356,252 A * 10/1994 Whistler, III ..... F16B 13/06 411/45
5,716,289 A * 2/1998 Okoneski ..... A63B 60/24 473/297
6,302,614 B1 * 10/2001 Tseng ..... F16B 7/1463 248/125.8
6,324,731 B1 * 12/2001 Pliml, Jr. ..... F16B 19/1081 24/297
7,582,023 B2 * 9/2009 Hung ..... A63B 53/14 411/55
7,806,600 B2 * 10/2010 Marrs ..... G02B 6/3802 385/55
8,337,322 B2 * 12/2012 Harper ..... A63B 57/50 473/286
8,678,944 B2 * 3/2014 Wall, Jr. ..... A63B 53/10 403/109.3
8,758,155 B1 * 6/2014 Demkowski ..... A63B 53/12 473/296
9,065,307 B2 * 6/2015 Sajdowitz ..... H02K 9/06
2012/0142444 A1 * 6/2012 Chol ..... A63B 53/10 473/296
2013/0344977 A1 * 12/2013 Chalifoux ..... A63B 53/16 473/299
2015/0231462 A1 * 8/2015 Chapin ..... A63B 60/34 473/300

* cited by examiner

*Primary Examiner* — Stephen Blau

(57) ABSTRACT

A key includes an out of round cross section which rotates to expand a compression unit in a golf club shaft. The top of the key has an extension which moves in a slot within the compression unit to define the maximum active and inactive positions.

11 Claims, 9 Drawing Sheets

OVAL COMPRESSION UNIT FOR INTERCHANGEABLE GOLF GRIP

CROSS REFERENCE TO RELATED PATENT APPLICATION

This application is a Continuation in Part application of U.S. patent application Ser. No. 15/176,200, filed 8 Jun. 2016, now U.S. Pat. No. 9,656,138, which is a Continuation in Part of U.S. patent application Ser. No. 15/138,162, filed 25 Apr. 2016, now U.S. Pat. No. 9,452,333 whereby the contents of both of these applications are hereby incorporated by reference.

BACKGROUND

1. Field of the Invention

U.S. patent application Ser. No. 15/176,200 describes a golf grip with an internal compression unit. A key is placed in a compression unit which when pressed expands the compression unit. Different cross section diameters of a hole going through the center of a compression unit result in the compression unit expanding when the internal key is pushed or rotated. The present invention rotates an out of round key in a central hole with different cross section diameters to cause expansion. Stops placed at the top of the compression unit define inactive to active compression. The present invention eliminates the use of ramps in the lower portion of the inner hole of an outer component.

The present invention refers to a method allowing quick placement and quick removal of golf grips onto a golf club. Quick change of golf grips allow golfers to try different golf grips on golf clubs before purchasing one. Quick change of golf grips further allows easy replacement of worn golf grips. Present methods to change a golf grip requires cutting off a golf grip, removing adhesive tape, reapplying adhesive tape, applying a slippery agent such as acetone and sliding on a new grip.

The present invention further allows perfect placement of a golf grip. If a golf grip is placed onto a golf club shaft and it is discovered to be misaligned, it is easily repositioned. It is further designed to allow different placement that makes a golf club longer or shorter.

2. Description of Concurrent Art

Golf grips aid a golfer in holding a golf club. Golf clubs include drivers, woods, irons, wedges and putters. Present grips come in a wide variety of sizes, shapes, colors, materials, textures, tapers, and the like. It is difficult to evaluate which grip fits a golfer's hand best and works best as a golfer cannot try them on a golf club and strike balls. Presently, a golfer evaluates how a grip feels in their hand with no golf club attached to the grip. If a golfer likes the feel of a grip in their hand, the grip is permanently attached to a club. If grips are attached to a golfer's clubs and they do not like them, it is an expensive and time consuming process to replace them.

Present technology to change a golf grip is complex enough that most golfers do not change their own grips but have professionals do it for them. Professional regripping is expensive and time consuming. The process to change a golf grip makes it difficult for a golfer to effectively evaluate grips.

It would be advantageous to have grips that simply slide onto a shaft and are secured with a simple turn of a component. It would be advantageous to have a technique that allows grips to be placed and removed in seconds for better selection at point of purchase and ease of replacement.

It would be further advantageous for a golfer to be able to adjust a grips position as required to perfect alignment with the club head or adjust a club length.

The United States Golf Association, referred to as the USGA, has specific rules for golf equipment that a golfer must follow for use in tournaments and professional play. USGA rules define specifications for grip shape, size, position and the like. One of the USGA rules is that a golf club and its components cannot easily be adjusted by a golfer during play. To change or adjust components on golf equipment, a special tool is required to adhere to USGA rules. The present invention has an alternative version with unique features created specifically to follow these rules.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses are revealed for creating and utilizing compression techniques to secure golf grips and make them easily interchangeable.

The proposed golf grip includes a compression unit which enters into a golf club shaft. A golf grip is placed onto a golf club shaft such that a compression unit enters the shaft. When the compression unit is engaged, the grip is secured.

In the preferred embodiment, a golf grip consists of a core which is surrounded by rubber, plastic or like materials to form a grip. The core is constructed of plastic, metal, rubber, ceramic, wood or any other common materials or combinations of materials. Outside covering materials form the individual shape, texture, color, text, logo, art and the like.

Components are manufactured in the usual manner including injection mold, stamping, bending, CNC, casting, pour molds, fabric infused rubber, 3D printing, blow molding, plastic molding techniques, coating, over molding, joining, laser cutting, pressing, spraying and other common methods. These common methods are categorized as forming, machining, casting, imaging/coating, molding, joining, additive and other. Components are further manufactured in one piece or multiple pieces and are joined by adhesive, snaps, friction, welding or the like.

A core fits over a golf club shaft. In the preferred embodiment, it expands over a shaft as it slides down to a final position. The core is passive in the preferred embodiment, but it can maintain constant compression onto a golf club shaft. The resulting friction stabilizes a grip.

A core is constructed inside a golf grip. It is placed directly onto a golf club shaft. Alternatively, core material is constructed inside a golf grip such that the core material does not touch the shaft. The core provides reinforcement to minimize bending and twisting of grip material. Rubber application is adhered, friction fit, taped, or directly over molded onto a core. A thin layer of printed rubber using polyurethane sheets provide specialized design when desired. These sheets are rubber thinly placed onto fabric.

Golf club shafts vary in diameter at the butt end. Common butt end dimensions are 0.560, 0.580 or 0.600 inches for different shafts. The diameter of a golf shaft decreases going down toward the club head. A shaft is parallel for the first several inches. In the preferred embodiment, the core expands to fit onto a shaft by material elasticity and or by core structural design.

In an alternative design, an internal support is placed within grip material and not exposed to the outside. It provides stiffness and resistance to movement. A compression unit inside a golf shaft transfers support to a grip through the core. A compression unit is joined to the core.

An alternative golf grip expands during placement and remains expanded when fully placed resulting in constant compression. The inside of the golf grip is smaller than the outside diameter of a golf club shaft. The resulting compression provides resistance to movement. Friction onto a golf shaft resulting from grip compression provides resistance to movement. The golf grip fits securely when in compression however it is not secure enough that movement would not occur during use. The grip is fixed securely with a compression unit. Resistance from core compression is weak enough to allow grip placement. A grip is not secure enough to play golf without securing a compression unit. In one alternative, a weak restickable adhesive lines the inside of a core.

A compression component joined to a core extends into a golf club shaft to stabilize a grip. The core and compression unit are difficult to manufacture in a cost effective way as a single unit. Each unit is manufactured separately and joined. The compression component and core provide adequate force to secure a grip to a golf club.

A central hole in a compression outer component accepts a key component. The key is rotated to expand the compression component. The top of the key has an extension that fits into a slot in the outer component. The slot limits movement and therefore key rotation. In the preferred embodiment, the key is limited to 90 degrees of motion. Without stops, the key turns more than 90 degrees. Beyond 90 degrees, the key decreases compression and snaps out of compression.

In an alternative embodiment for USGA approval, the central key includes a lower out of round section. The key is placed inside an outer component. The outer component has a split lower section resulting in leg like extensions. Rotation of the key engages areas of decreased diameter inside the outer component which results in compression component leg movement outward. Expansion of the compression unit results in compression onto the inside wall of a golf club shaft. The compression unit is joined to the golf grip core resulting in a stabile golf grip. In the preferred embodiment, the outer unit is oval shaped on the outside resulting in distortion of a golf club shaft to an oval shape when a compression unit is active.

In the preferred design, the key component is in one of two positions. The key is either in full inactive or full active compression. It is difficult for it to be stable in positions between active and inactive. In the inactive position, the inner diameter of the compression unit is the same or greater than the diameter of the key component. In the active position, the inner diameter of the compression unit is less than the diameter of the key component.

Forces against shaft walls are transferred to the inside of the compression unit forcing the key to slide into one position or the other. If the key turns 20 degrees, forces return it to the inactive position. In the preferred embodiment designed for USGA approval, the inner central key component is either in active or inactive compression. The amount of rotation can vary but in the preferred embodiment movement is ninety degrees. Snap features can be used on the upper extension of the key and the slot of the outer unit.

Component dimensions determine the amount of force onto a key and what position is stable so the key does not rebound to a new position.

A key lower section is oval, square, triangular, or like shapes in cross section to provide a snap like movement from one position to the other. In the preferred embodiment, a key varies in shape from top to bottom. The center portion is round to guide rotation. Portions may include extensions or out of round areas to limit the amount of rotation. Out of round cross section may be at the top and the bottom of the key. A special tool such as a hex Allen wrench engages the top of the key component. It provides a means to engage the central key component and transfer force for rotational movement. In the preferred embodiment, the bottom section of the key has an oval cross section and the inside hole of the outer component has an oval cross section.

As an example of use, a golfer wants to try different grips on a putter to determine which grip is most comfortable and allows them to golf best. A grip is placed onto a putter shaft by pressing it downward and secured with the compression unit by a quick 90 degree key turn. The grip is removed and the next one placed. Several grips are quickly changed and tried to determine the best one. Once a decision has been reached, the compression unit is secured. Alternatively, a golfer may cement or adhere with adhesive tape the grip, though this is not preferred.

The present design further allows a golfer to position the grip fully or partially onto a golf club shaft effectively changing golf club length. The internal compression unit must be sufficiently long in a golf club shaft to secure it however, as much as several inches change can be completed by design.

A golf club shaft diameter decreases as one moves down the shaft. The end of a golf grip has a matching smaller diameter to the point it will sit on a shaft. The grip core is split into sections at the end to allow expansion. When the end of a golf grip is placed onto a golf club shaft, it expands. The end of the core may have one or many splits for expansion. In the preferred embodiment, the end remains in compression for greater stability.

In the preferred embodiment, a core inside a grip has a long split starting within the top portion and extends part way down the core. A section of the core at the top butt end is solid without a slot. Four slots start at the opposite end of the core extending part way up and passes the opposite split.

An outside cover grip component is molded directly onto an inner core or manufactured separately and secured with adhesives, tapes, friction or like methods. Components can be constructed with various coatings or layers such as rubber inside or outside.

The USGA, United States Golf Association, rules state that a golfer cannot adjust components on golf clubs during play. Present compression units revealed in previous patents provide controlled compression with threaded screws. A compression unit using screws can be tightened part way and create enough force to use a golf club but be adjustable. For example, a compression unit is tightened part way on a putter. A screw is turned 10 degrees. There is enough compression for a golfer to putt however; if enough hand force is applied to the grip, it can move and be adjusted. This is in violation of USGA rules. For this reason, the preferred embodiment of this invention uses an out of round outer component and key designed to be stable in the 0 and 90 degree positions. Multiple positions may be used for multiple expansions to fit different size shafts.

A key component turns inside an outer component resulting in the expansion of the compression component inside a golf shaft. An out of round component which is part of the inside hole of the compression unit, engages the key component. The key must go past a certain amount of rotation before it can remain in that position. It cannot stop part way and thus will be acceptable to USGA requirements. An alternative is certain shapes such as a rounded rectangle shape to simulate this force action.

The foregoing has outlined the more pertinent and important features of the present invention in order that the detailed description of the invention that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

There has thus been outlined, rather broadly, the more important features of the versatile compression interchangeable golf grip system and series of accompanying systems and apparatuses and embodiments in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

To the accomplishment of the foregoing and related ends, certain illustrative aspects are described herein in connection with the following description and the annexed drawings. These aspects are indicative of the various ways in which the principles disclosed herein can be practice and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

The advantages of the present apparatus will be apparent from the following detailed description of exemplary embodiments thereof, which description should be considered in conjunction with the accompanying drawings, in which: Having thus described the system in general terms, reference will now be made to the accompanying drawings, which are not necessarily drawn to scale, and wherein.

DETAILED DESCRIPTION OF THE PREFERRED EMBODIMENTS

Figure 1:
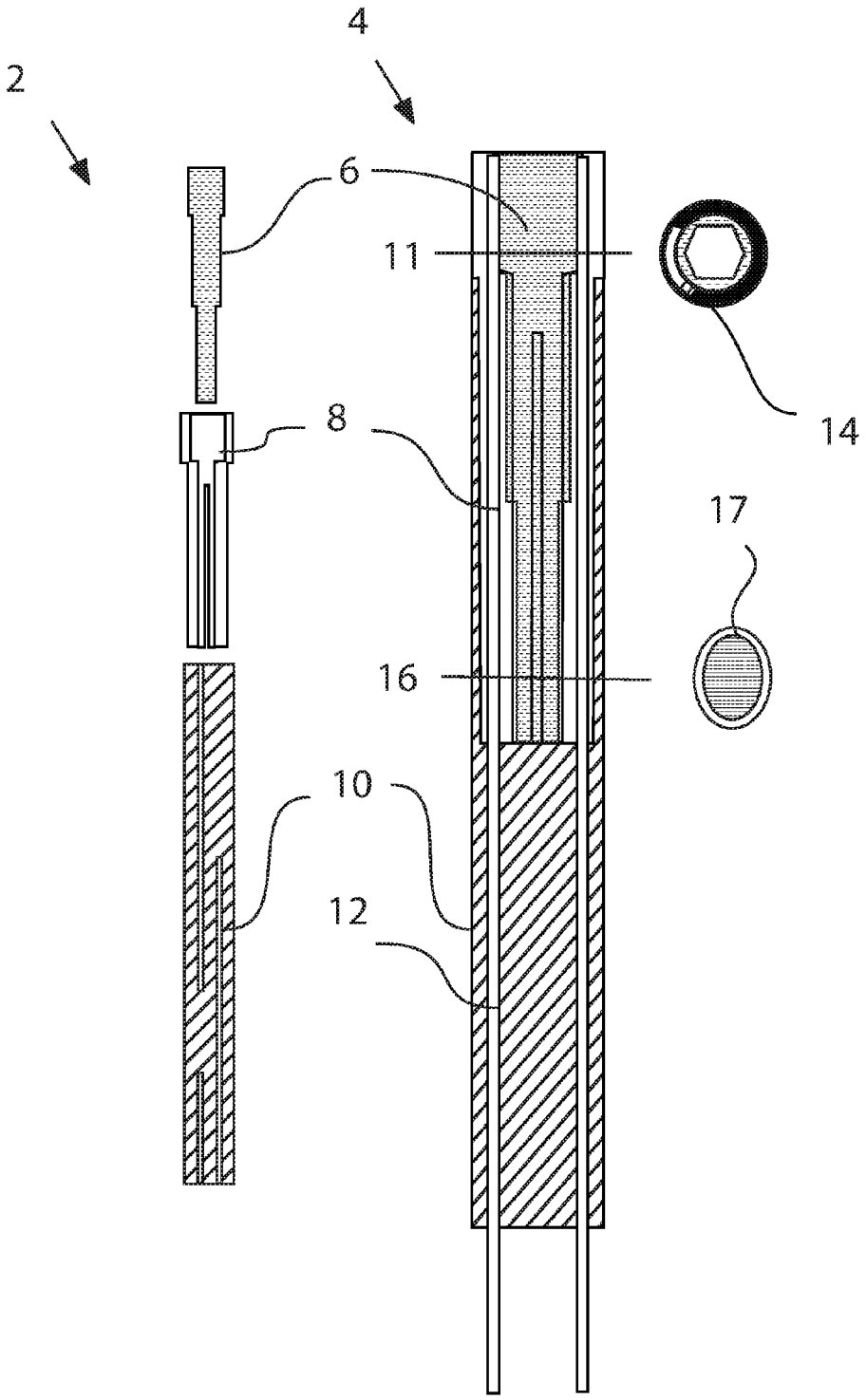
FIG. 1 illustrates an isometric and a cross section view of the golf grip of this invention.
Figure 2:
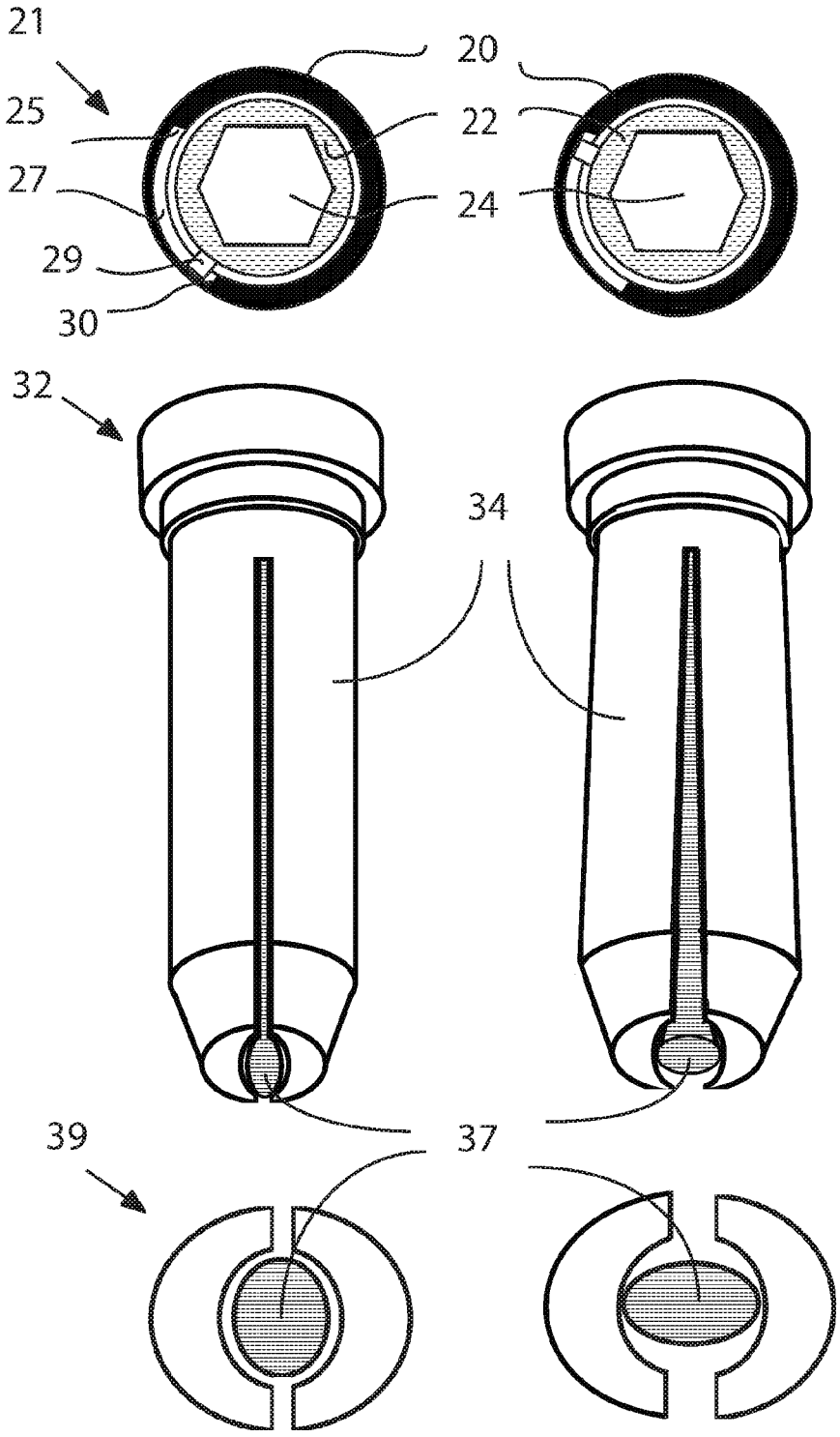
FIG. 2 illustrates and isometric view of an alternative of this invention.

Referring to FIG. 1, view 2 shows components used while view 4 shows the same components assembled and placed on golf shaft 12. Key 6 fits inside outer component 8, which fits inside and is joined to core 10. When placed on golf shaft 12, outer component 8 with key 6 in it and joined to core 10 fits inside the shaft while core 10 slides outside shaft 12. A rubber component not shown is place onto core 10. Extension 14 seen at cross section 11 limits rotation of key 6 while oval cross section 17 shows oval shape 17 of key 6 lower section which produces outer component expansion when turned Referring to FIG. 2, top view 21, side view 32 and bottom view 39 shows a compression unit in the active and inactive position. Illustrations on the left side are in the inactive position while those on the right side are in the active position. Key 22 with hex drive hole 24 is placed into outer component 20. Key 22 rotates when a hex shaped driver turns the key. Key 22 has extension 29 attached. Extension 29 slides in slot 27 of outer component 20. In the inactive position, extension 29 strikes wall 30 of slot 27 to stop further rotation. In the active position, extension 29 strike wall 25 of slot 27 to stop further rotation as seen on the right side view. Legs 34 of outer component 20, spread apart as key 22 is turned. End view 37 shows the oval shaped key expanding the compression unit as a result of engaging a decrease diameter.

The lower section of the key is oval. The lower internal diameter of the compression unit is oval resulting in a decreased inner diameter of a cross section view when compared horizontal to vertically measured. Rotating the key causes the larger key dimension to engage the decreased inner outer component central hole diameter forcing it outward. Initial engagement of the key onto inside outer component walls creates forces pressing the key back to its original position. At some point friction balances the forces wanting to return the key back to its original position. The more elongated an oval cross section of the key and compression unit a more degree turn is required to reach this position.

A large amount of force is required to turn the key as compression increases onto the inside walls of a golf club shaft. When the force releases as the key gets closer to 90 degrees, the key is forces quickly beyond 90 degrees. To stop the excess turning, stops are created.

It is important for the key to be in an inactive position so the compression unit can slide into a golf club shaft. If the compression unit is not in the inactive position, the increased compression unit diameter blocks it from entering the shaft. Again a stop is created to define the inactive position.

Figure 3:
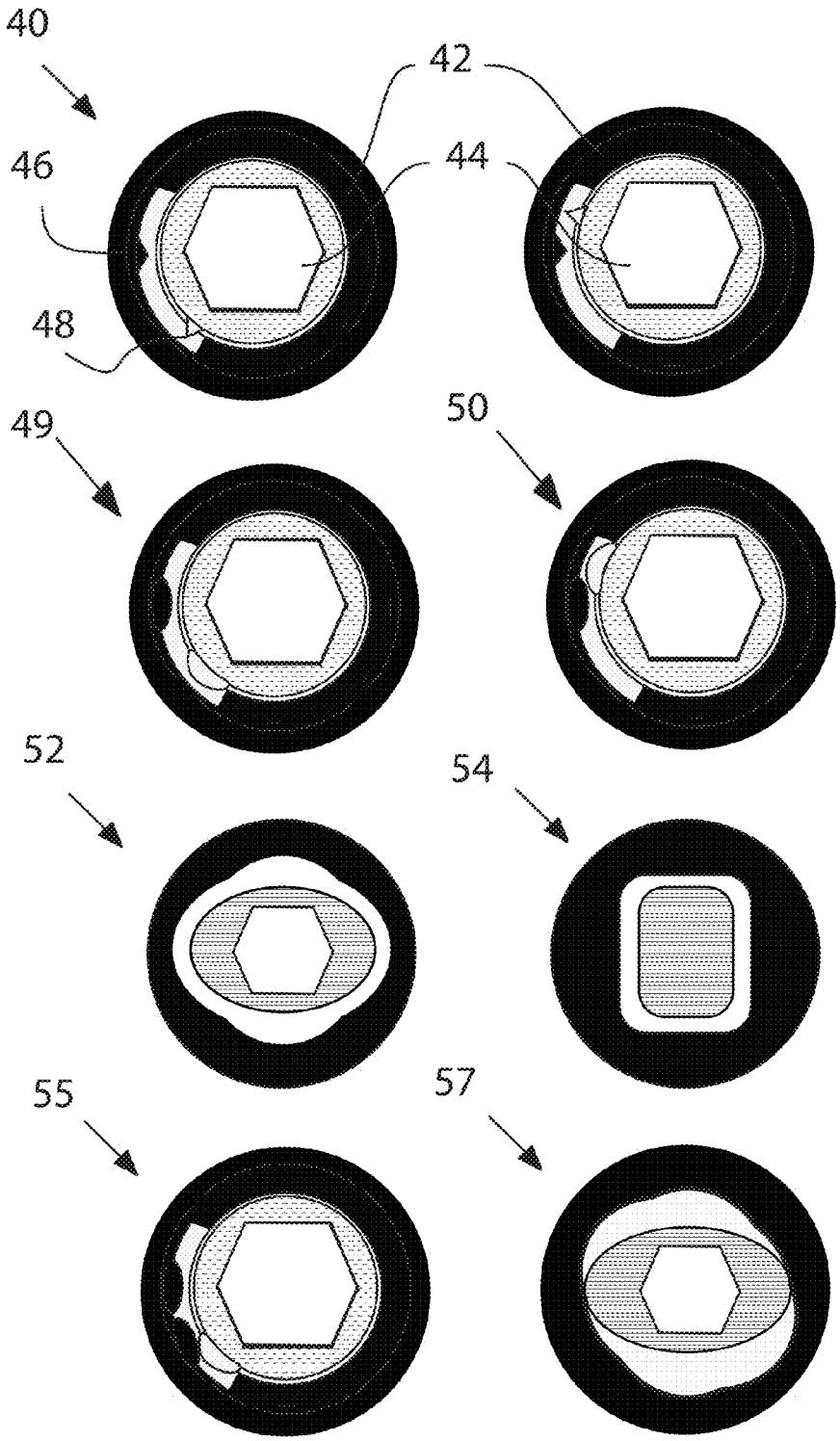
FIG. 3 illustrates top views of alternative key and compression units of this invention.

Referring to FIG. 3, various compression unit and key designs are viewed from the top. Compression unit 40 is shows positions as active on the right and inactive on the left. Key 44 is positioned in outer component 42. Extension 48 of key 44 must snap past extension 46 of outer component 42 to get to an active compression position. The snap provides a more definitive boundary between active and inactive positions.

Compression unit 49 shows round extensions in the inactive position while compression unit 50 shows the same unit in the active position. Extensions snap over each other in this design.

Compression units 52, 54 and 57 show alternative designs of this invention. Compression unit 55 shows the use of multiple snaps to define multiple positions.

Figure 4:
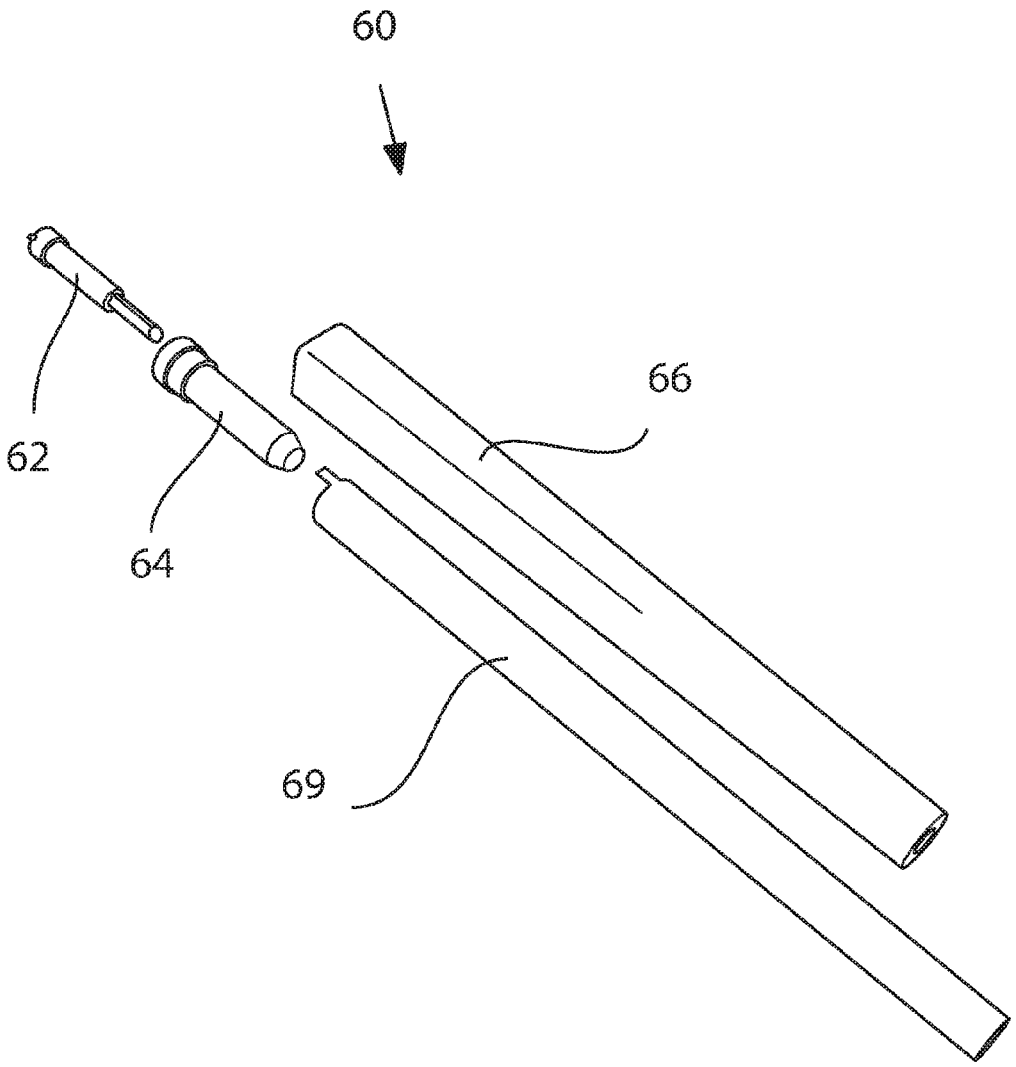
FIG. 4 illustrates an isometric view of the components of this invention.

Referring to FIG. 4, golf grip 60 consists of key 62 that slides into outer component 64. Outer component 64 slides into and is fixed to core 69. Core 69 slides into and is fixed to rubber 66.

Figure 5:
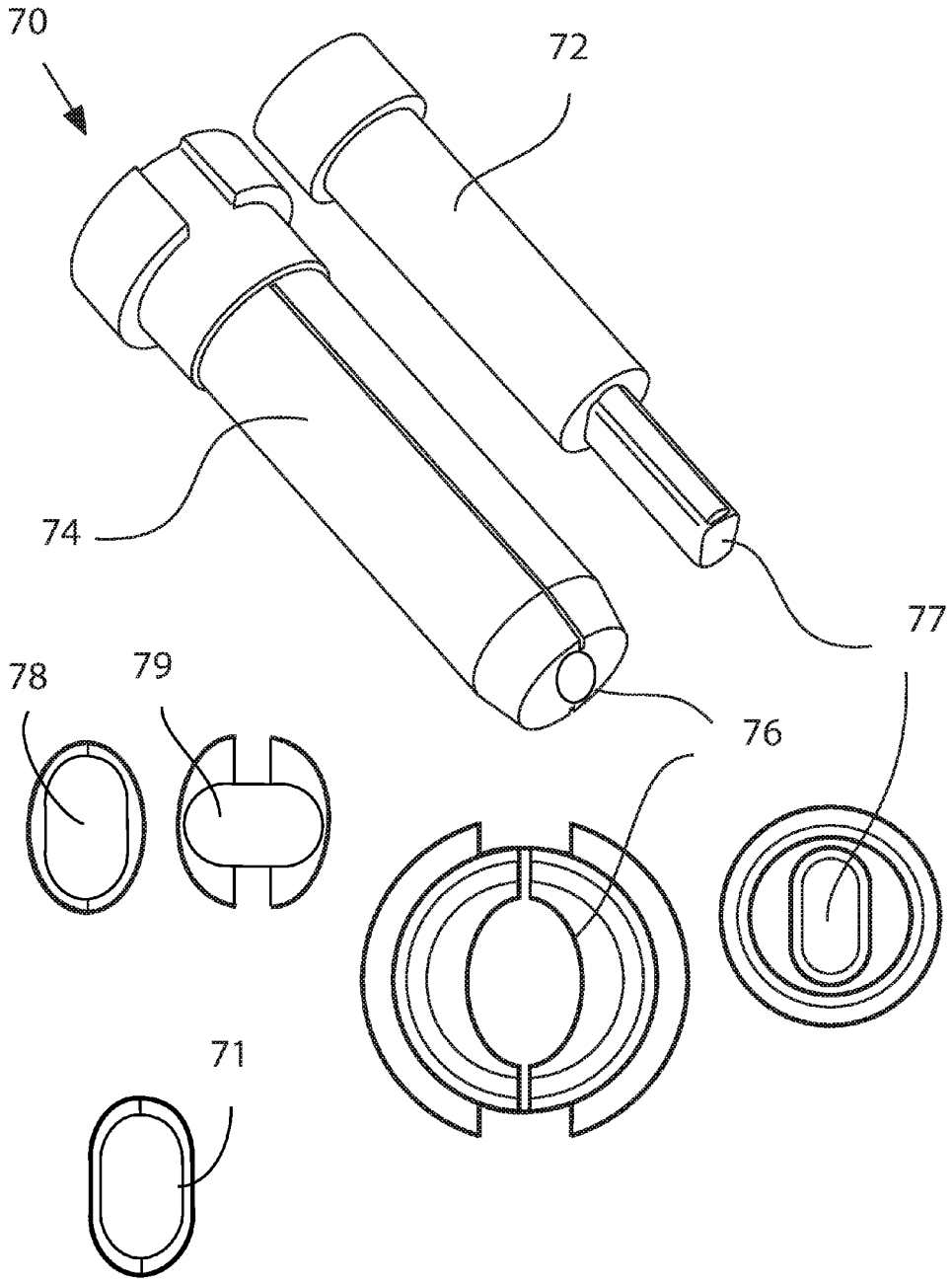
FIG. 5 illustrates an isometric view of an alternative of this invention.

Referring to FIG. 5, compression unit 70 has key 72 that slides into outer unit 74. The lower end 77 of key 72 is slot shaped while inner hole 76 of outer unit 74 is oval shaped. Cross section 78 shows the key in an inactive position while cross section 79 shows the key in an active position resulting in expansion of the compression unit. Cross section 71 shows a slot shaped key and a slot shaped inner hole of an outer unit. A combination of various shapes may be combined.

Figure 6:
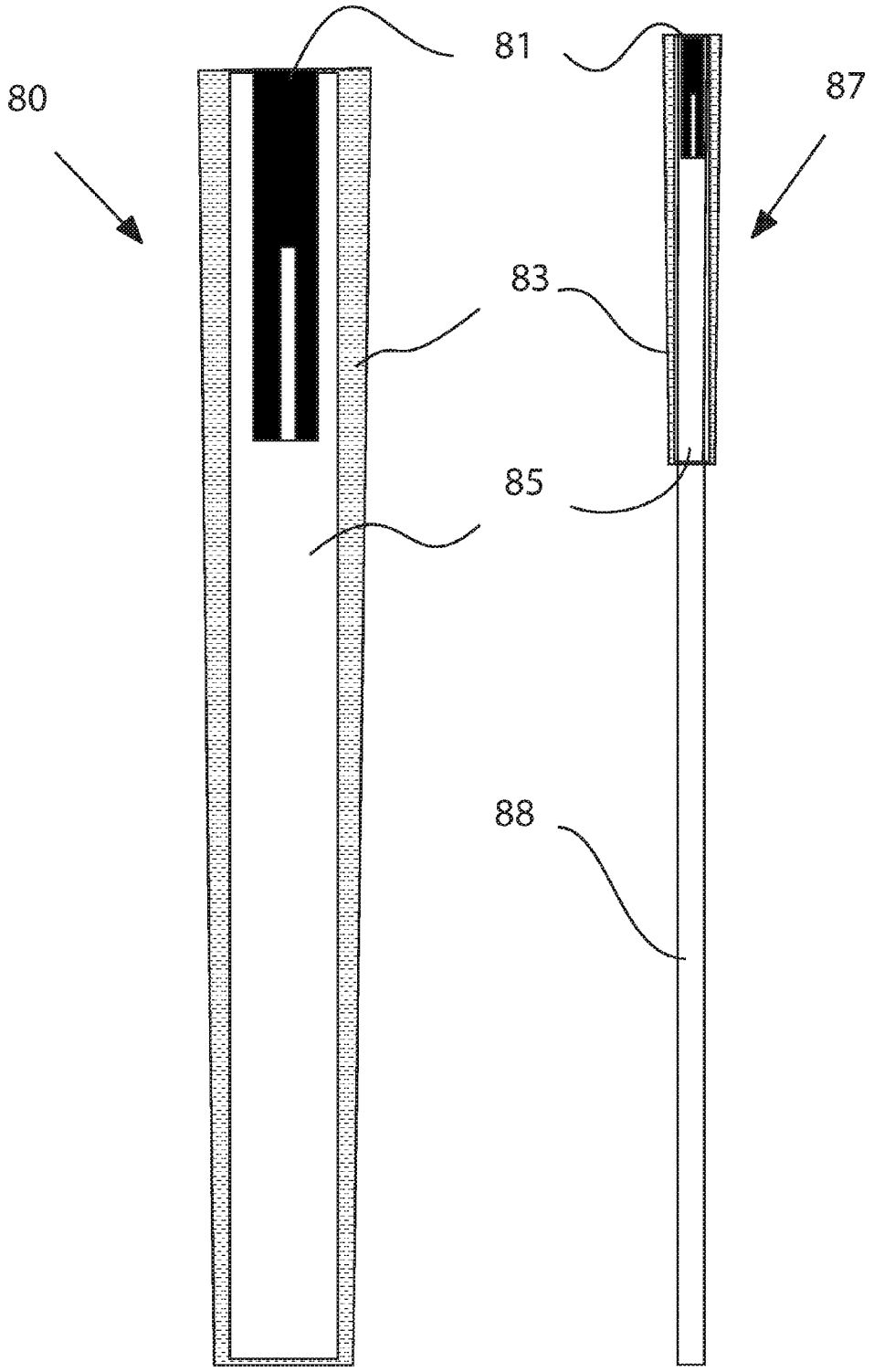
FIG. 6 illustrates a cross section view of the components of this invention.

Referring to FIG. 6, golf grip 80 has compression unit 81 joined to core and outer grip 83 with central hole 85. Golf Club shaft 88 enters golf grip 80 through hole 85 such that outer grip 83 remains on the outside of the shaft and compression unit 81 enters into the shaft.

Figure 7:
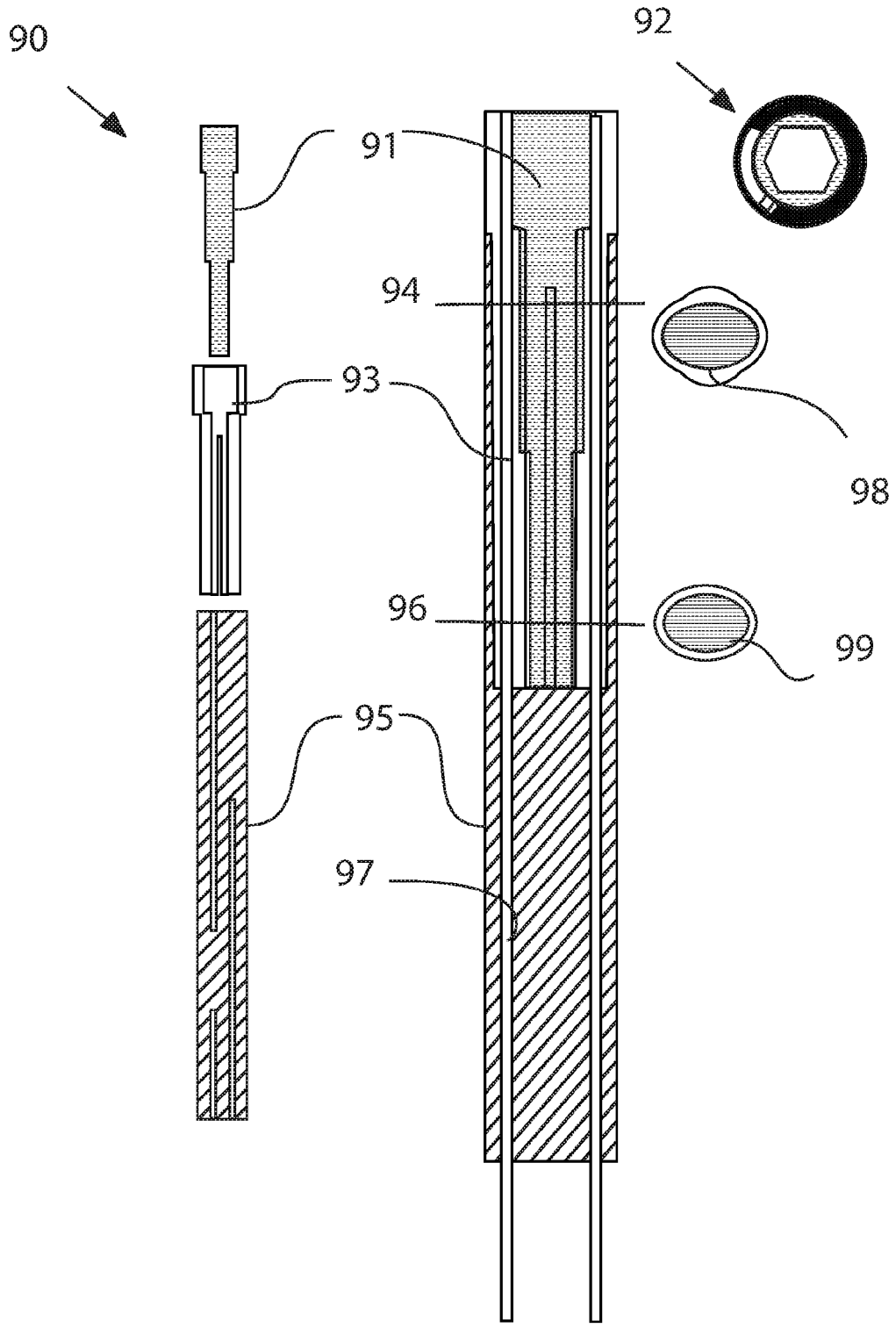
FIG. 7 illustrates an isometric and a cross section view of the golf grip of this invention.

Referring to FIG. 7, golf grip 90 has key 91 that enters into outer component 93 that enters into core 95 which is placed onto shaft 97. Cross section 96 shows oval shaped key 99 and oval shaped inner hole of compression unit 93. Cross section 94 shows midsection snap 98 placed in the midsection instead of the upper section. Alternatively, cross section unit 92 is placed in the midsection 94.

Figure 8:
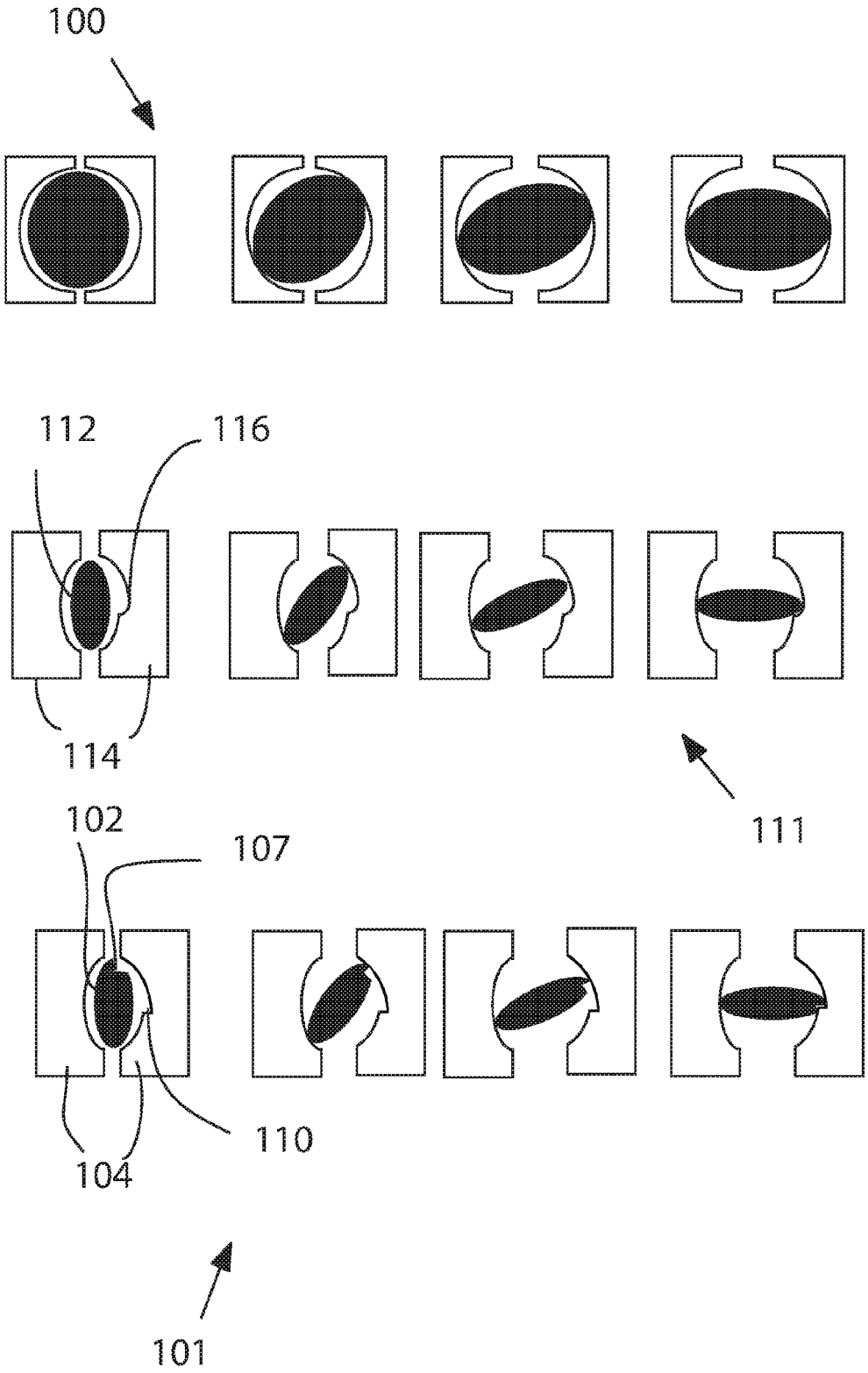
FIG. 8 illustrates a cross section view of alternative key and outer component shapes.

Referring to FIG. 8, cross section 100 shows a rotation series of a wide oval key rotating inside a matching shaped outer component resulting in compression unit expansion. A wide oval creates earlier friction than a narrow oval. This results in less snap back force applied to the key. Depending on the desired snap back and required dimensions for strength affects final design. Each turn shown produces different amounts of expansion such that the compression unit will fit multiple shaft diameters such as 0.560, 0.580, 600 and 0.620 inch golf shafts.

Cross section 111 shows expansion caused by narrow oval key 112 inside a matching shaped outer component 114. Ledge 116 created by a differential diameter cross section of the inside of outer component 114 and stops key 112 from rotating beyond 90 degrees.

Cross section series 101 shows key 102 with ledge 107 and outer component 104 with ledge 110 limiting rotation of said key to 90 degrees.

Figure 9:
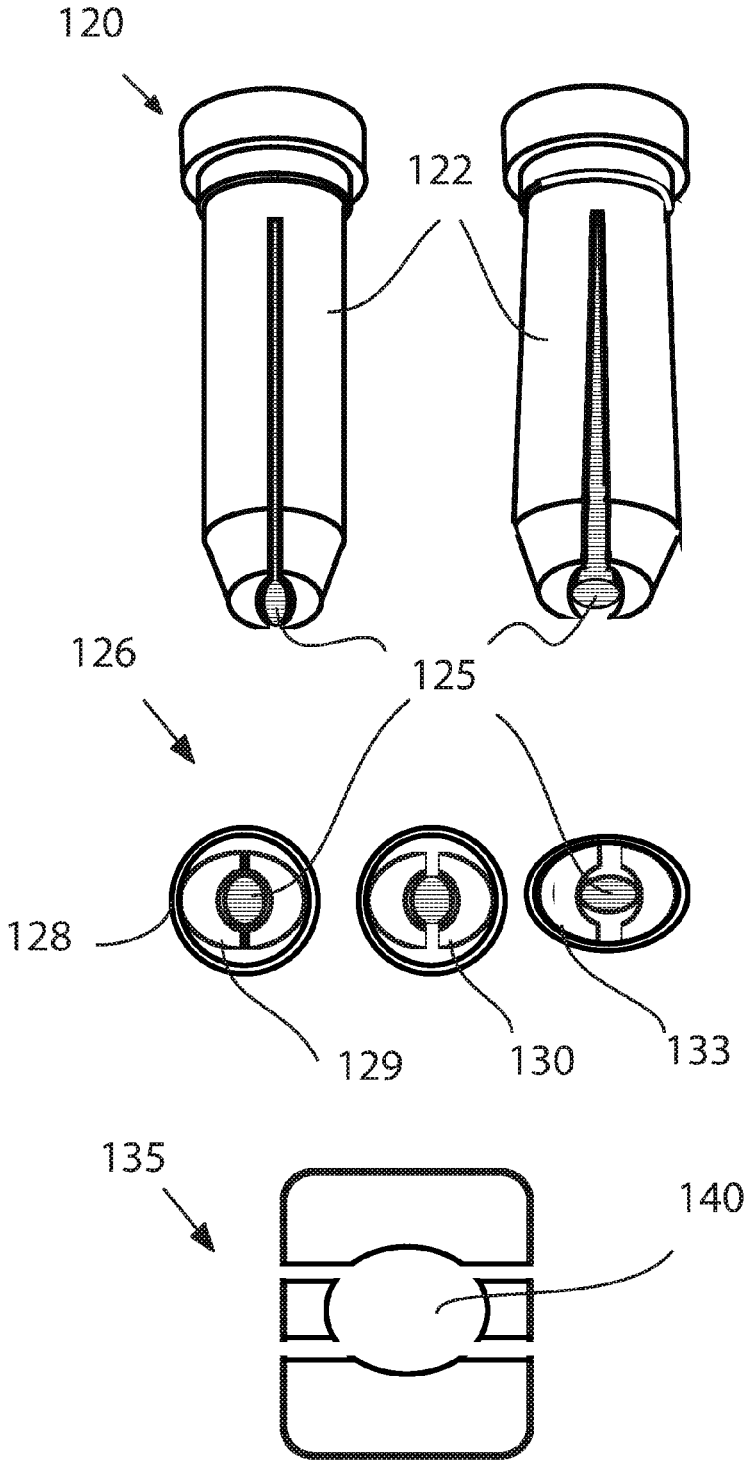
FIG. 9 illustrates isometric and cross section view of a core.

Referring to FIG. 9, an isometric view 120 shows an inactive compression unit on the left and an active compression unit on the right. Outer component 122 has a central hole with different cross section diameters and shapes. A central hole holds out of round key 125.

Cross section view 126 shows key 125 inside an outer component which is inside shaft 128. Outer component lower cross section outer shape is oval and wider than the shaft diameter. For example, the inner shaft diameter is 0.540 inches and the largest diameter dimension of the outer component is 0.550 inches. A slot done the lower section of the outer component allowing expansion also allows the legs to squeeze closer together when pressed into a shaft. Outer unit 120 shows the legs of the outer unit squeezed together. Oval outer component 130 shows the same leg of the outer component separating and distorting the shaft to become oval. When outer component 133 is fully active by key 125 turning 90 degrees, the shaft distorts to form a similar oval shape. Shaft distortion aids in resisting rotational forces as mechanical resistance is applied and not just friction. To aid shaft distortion and minimize adverse forces from the surrounding core, core 135 has a matching oval central hole 140 which further resists rotational movement of the grip on the shaft.

The invention claimed is:

1. A golf club grip that includes:

a snap compression unit that enters into a golf club shaft comprises:

an inner component which is an internal key, and said internal key has a bottom section being out of round such that it is of greatest diameter in one direction than another, and said internal key has an upper section, said upper section includes a means to limit the amount of rotation; and an outer component with a variable internal hole cross section, said internal hole cross section in a second direction is of the same or greater diameter than the greatest diameter of the said bottom section of said internal key and less than the greatest diameter of the said bottom section of said internal key in a different direction than the second direction, said variable internal hole cross section with a varying diameter results in expansion of the outer surface of the outer component and thus compression of the outer component when the outer surface contacts the inner wall of a shaft when said internal key is rotated.

2. The golf grip of claim 1, wherein the internal key is turned 90 degrees to cause full compression.

3. The golf grip of claim 1, wherein the internal key is turned less than 90 degrees to cause full compression.

4. The golf grip of claim 1, wherein an extension is added to said upper section of said internal key, and said extension moves in a slot added to upper section of said outer component.

5. The golf grip of claim 4, wherein said internal key extension engages an extension in the inside hole of the upper section of the outer component, said extension engagement results in compression to snap from an inactive position to an active position.

6. The golf grip of claim 1, wherein cross section of said upper section of said internal key is out of round and cross section of said internal hole of said upper section of said outer component is out of round.

7. The golf grip of claim 6, wherein said internal key amount of rotation is limited by the cross section shape of said upper section of said internal key interacting with cross section shape of the internal hole of said upper section of said outer component.

8. The golf grip of claim 1, wherein said outer component outside cross section is oval in the lower half.

9. The golf grip of claim 8, wherein a core attached to said compression unit has a central hole with an oval cross section in the upper section.

10. The golf grip of claim 1, wherein a core is attached to said compression unit.

11. The golf grip of claim 10, wherein said core has a central hole with an oval cross section in the upper section.

* * * * *